US005283933A

United States Patent [19]

Wiseman et al.

[11] Patent Number: 5,283,933

[45] Date of Patent: Feb. 8, 1994

[54] BELT BUCKLE WITH INTERACTIVE DUAL TONGUES

[75] Inventors: Michael A. Wiseman; James R. Chinni, both of Indianapolis, Ind.

[73] Assignee: Indiana Mills & Manufacturing, Inc., Westfield, Ind.

[21] Appl. No.: 9,327

[22] Filed: Jan. 26, 1993

Related U.S. Application Data

[63] Continuation-in-part of Ser. No. 896,208, Jun. 10, 1992, Pat. No. 5,182,837, which is a continuation-in-part of Ser. No. 714,710, Jun. 13, 1991, Pat. No. 5,142,748, which is a continuation-in-part of Ser. No. 536,170, Jun. 11, 1990, Pat. No. 5,038,446, which is a continuation-in-part of Ser. No. 370,240, Jun. 22, 1989, Pat. No. 5,023,981.

[51] Int. Cl.[5] ..... A44B 11/00

[52] U.S. Cl. ..... 24/642; 24/632; 24/573.5

[58] Field of Search ..... 24/642, 632, 635, 638, 24/639, 643, 573.5, 655, 656, 664, 640, 641

[56] References Cited

U.S. PATENT DOCUMENTS

| | | | |
|---|---|---|---|
| 3,523,342 | 8/1970 | Spires | 24/632 |
| 3,605,210 | 9/1971 | Lohr | 24/635 |
| 4,128,924 | 12/1978 | Happel et al. | 24/632 |
| 4,617,705 | 10/1986 | Anthony et al. | 24/642 |

FOREIGN PATENT DOCUMENTS

86/03386 6/1986 PCT Int'l Appl. .

*Primary Examiner*—Victor N. Sakran
*Attorney, Agent, or Firm*—Woodard, Emhardt, Naughton Moriarty & McNett

[57] ABSTRACT

A pair of interactive tongues are for latching to a dual-tongue belt buckle. The belt buckle includes false latching features that only permits the latching mechanism to trigger when both of the tongues are fully inserted into the buckle. The contact surfaces of the first and second tongues include interactive features that prevent the tongues from sliding past one another in the direction of the tongue bars when the contact surfaces are meshed. The interactive features of the contact surfaces are shaped and configured so that the contact surfaces can be meshed by moving the tongues toward each other in a plurality of different directions that are perpendicular to the direction defined by the tongue bars.

12 Claims, 12 Drawing Sheets

BELT BUCKLE WITH INTERACTIVE DUAL TONGUES

REFERENCE TO RELATED APPLICATIONS

This application is a continuation-in-part of our allowed U.S. patent application Ser. No. 07/896,208, filed on Jun. 10, 1992 entitled BELT BUCKLE WITH EJECTOR MODULE AND TONGUE STOP (now issued as U.S. Pat. No. 5,182,837), which is continuation-in-part of our U.S. patent application Ser. No. 07/714,712, filed on Jun. 13, 1991, now U.S. Pat. No. 5,142,748, in turn a continuation-in-part of U.S. patent application Ser. No. 07/536,170, filed on Jun. 11, 1990, now U.S. Pat. No. 5,038,446, in turn a continuation-in-part of U.S. patent application Ser. No. 07/370,240, filed on Jun. 22, 1989, now U.S. Pat. No. 5,023,981.

BACKGROUND OF THE INVENTION

A seat belt buckle devised to maximize holding capability as well as to improve the cost and ease of manufacture is disclosed in the U.S. Pat. No. 4,617,705 issued to James R. Anthony and Allan R. Lortz. The buckle includes a reinforcement plate mounted to and between an upper and lower housing containing a spring biased pawl engageable with a seat belt tongue. The pawl is held captive between the lower housing and the reinforcement plate, and is biased upwardly against the plate by a pair of springs. A push button is slidably mounted to the upper housing and has a pair of legs extending downwardly through the plate to contact and move the pawl downwardly to disengage the pawl from the tongue. An additional spring mounted between the push button and reinforcement plate requires force above a predetermined level to move the button downwardly to disengage the pawl from the tongue. In many cases, the seat belt tongue is split into two separate tongues for attachment respectively to a seat belt and a shoulder harness. In order to increase the fit and engagement between the buckle and the tongue or pair of tongues inserted into the buckle and to ensure the tongues are not mounted upsdie down in the buckle, it is custom to provide a pair of flanges extending outwardly from the reinforcement plate to engage and provide a stop means limiting motion including pivotal motion of the tongue(s).

In the case of a belt buckle engageable with a pair of tongues, it is desirable to provide a buckle that will not lockingly engage when only a single tongue is inserted into the buckle. We have therefore devised a belt buckle, disclosed in our U.S. Pat. Nos. 5,023,981 and 5,038,446, which will lockingly engage the tongues only when both tongues are fully inserted therein. However, simultaneously inserting the dual tongues into the buckle in order to trigger the latching mechanism is not always a trouble-free exercise. For instance, one solution was to provide dual tongues which interlocked together as in tongue 100 shown in FIG. 1 of the present application. Dual interlocking tongues essentially become a single tongue when interlocked together before being inserted into the buckle. Dual interlocking tongues suffer from a number of disadvantages not least of which is the difficulty in connecting the interlocking features when hands are needed for other tasks such as keeping a squirming infant properly positioned in a child restraint seat while the restraints are being secured. FIG. 9 of the present application illustrates another dual tongue system 300 that has mating surfaces to aid the user in simultaneously inserting dual tongues into the buckle. While this type of dual tongue can substantially eliminate some of the problems encountered in interlocking dual tongues, these designs still have the drawback that the dual tongues can slide relative to one another, and therefore can result in some difficulty inserting both tongues simultaneously into the buckle in order to trigger the latching mechanism.

Another system known in the art for securing at least two webs to a single buckle is to provide one of the webs with an ordinary tongue and the other with a plastic or metallic loop in place of a tongue. The loop is sized large enough to receive the tongue bar of the tongue but is too small to slip over the handle portion of the tongue. The webs are secured to the buckle by advancing the tongue bar of the tongue through the loop and then advancing the tongue bar into the buckle to trigger the latching mechanism. In this way, the web having the loop attachment is trapped between the buckle and the handle portion of the tongue. Like the prior art just discussed, this type of tongue and loop system suffers from the disadvantage of not always being easily assembled before the webs are secured to the belt buckle.

What is needed is a pair of dual interactive tongues that retain the advantages of both interlocking dual tongues and those having other mating features but does not suffer from their respective disadvantages nor introduce new drawbacks to a dual tongue buckle system.

SUMMARY OF THE INVENTION

One embodiment of the present invention is a belt buckle-tongue combination comprising first and second individual tongues, each having a main body with a contact surface and a web aperture, and each further including a tongue bar extending from the main body in a first direction. The contact surfaces of the two tongues are shaped to mesh with one another and also include interactive means formed thereon for advancing the two tongues simultaneously in the first direction when the contact surfaces are meshed but only one of the tongues is pushed in the first direction. A buckle main body has a cavity therein shaped to force the contact surfaces of the tongues to mesh when one of the tongues is partially received in the cavity and the other of the tongues is inserted into the cavity in the first direction. A movable latch is mounted in the body and is movable from an unlatched position to a latched position wherein the latch engages the tongue bars of the two tongues. A manual operating means accessible at the exterior of the buckle main body is provided for moving the latch between its latched position and the unlatched position in order to release the two tongues from locking engagement with the buckle main body. Finally, a false latching means that is movably mounted in the buckle main body and contactable and moved by the first and second tongues when the two tongues are inserted into the buckle main body is also provided. The false latching means is operable to allow the latch to lockingly engage the two tongues when both tongues are simultaneously fully inserted into the buckle main body but is further operable to hold the latch from moving to its latched position when only one of the two tongue bars is inserted into the buckle main body.

Another embodiment of the present invention is a method of latching a safety belt buckle comprising the steps of providing a pair of individual tongues each having a main body with a contact surface, a web attachment aperture and a tongue bar extending from the main body in a direction. The contact surfaces include interactive features that prevent the tongues from sliding past one another in the direction when the interactive features are engaged with one another. A belt buckle is provided that will latch to the pair of individual tongues when the tongues are simultaneously fully inserted into the belt buckle. In the next step, one inserts one of the tongue bars into the belt buckle in the direction. Next, the other of the tongue bars is inserted into the buckle in the direction until the interactive features of the contact surfaces engage each other. Finally, one of the tongues is pushed in the direction so that the engagement of the interactive features will simultaneously advance both of the tongues until both are fully inserted into the belt buckle and latched thereto.

It is an object of the present invention to provide new and improved interactive dual tongues for a seat belt buckle.

In addition, it is an object of the present invention to provide an improved method for latching dual tongues to a belt buckle.

Related objects and advantages of the present invention will be apparent from the following description.

DESCRIPTION OF THE PREFERRED EMBODIMENTS

Figure 1:
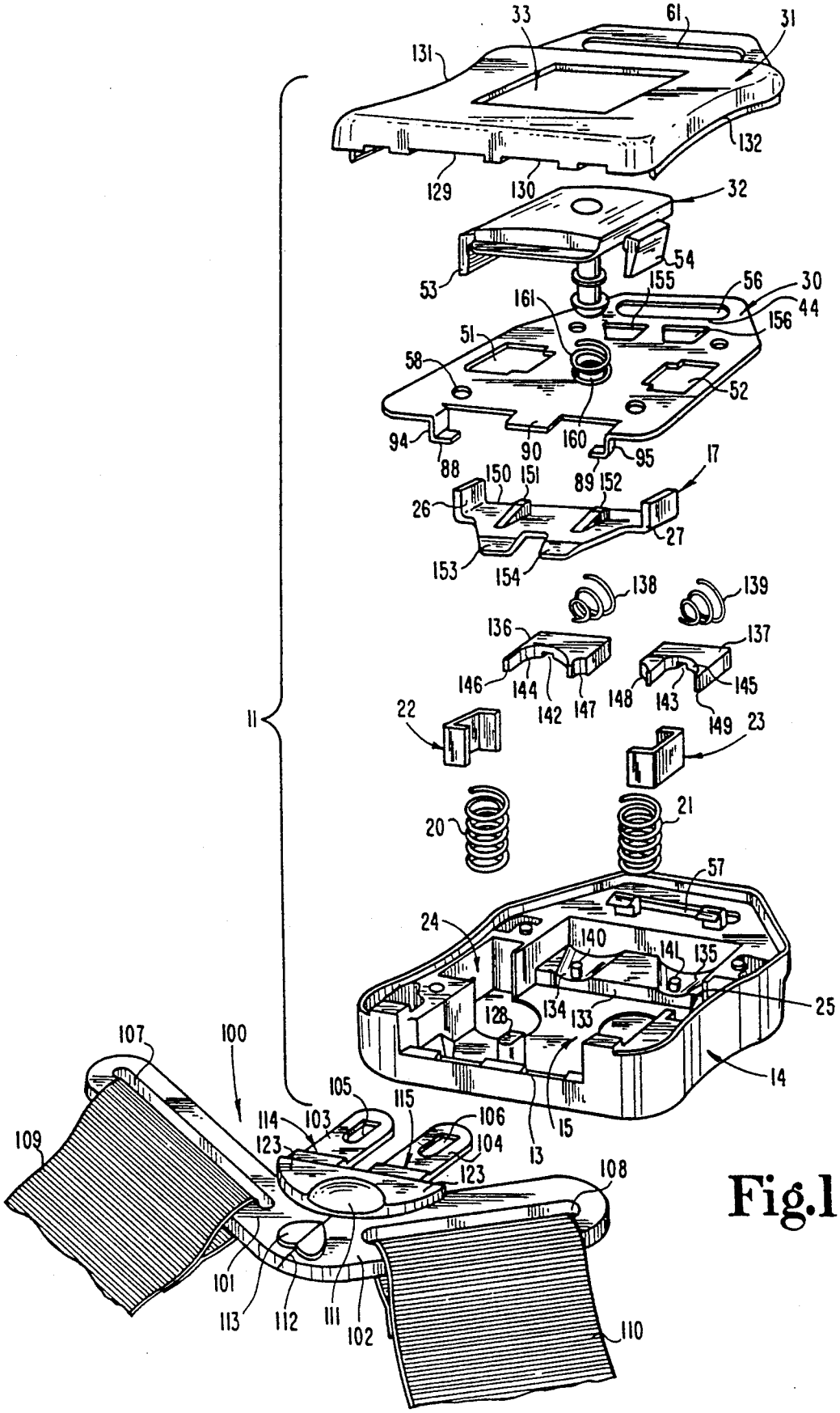
FIG. 1 is an exploded, perspective view of a buckle and tongue combination.

For the purposes of promoting an understanding of the principles of the invention, reference will now be made to the embodiments illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Referring now more particularly to FIG. 1, there is shown an alternate embodiment of a buckle tongue combination consisting of a buckle 11 shown in exploded view and a buckle tongue 100 consisting of a pair of interlocking, but separable, buckle tongues 101 and 102. Buckle 11 includes a main body 14 having a mouth 13 for receiving the leading edge of tongue 100 which extends into a cavity 15 formed in main body 14. Tongues 101 and 102 include apertures 105 and 106 through which two upraised portions 151 and 152 of pawl or latch 17 project. Tongues 101 and 102 include second apertures 107 and 108 with webs 109 and 110 extending there through. The two webs may represent a seat belt and harness shoulder web. A pair of helical springs 20 and 21 rest within cavity 15 and urge latch 17 to the upward position whereat the latch is locked to tongue 100. A pair of channels 22 and 23 are secured within complementary sized cavities 24 and 25 opening into main cavity 15. Channels 22 and 23 slidably receive the mutually opposed and upturned arms 26 and 27 of latch 17. The forward edge of latch 17 is split into a pair of legs 153 and 154 having an upper surface beveled downwardly to guide tongues 101 and 102 toward the upraised portions 151 and 152 of the latch which are extendable through apertures 105 and 106. Springs 20 and 21 are positioned between the bottom wall of main body 14 forming cavity 15 and the under surface of latch 17. A reinforcement plate 30 is attached to main body 14 and in turn is attached to cover 31 with a push button 32 located between cover 31 and plate 30 and projectable partially through aperture 33 of cover 31 to allow the operator to depress the button thereby depressing latch 17 to the downward or unlocked position. Button 32 includes lateral extensions positioned beneath cover 31 preventing the button from escaping the buckle described in U.S. Pat. No. 4,617,705 herewith incorporated by reference. Button 32 also includes legs 53 and 54 which contact the upper surface of the latch immediately inward, respectively, of arms 26 and 27 once the button is pushed sufficiently downward to unlatch the tongues. Helical spring 161 is positioned between button 32 and plate 30 surrounding sleeve 160 and is operable to force the button upwardly, but yieldable to allow the button to be depressed thereby releasing the latch from the tongues. Spring 161 increases the positive force required to depress button 32.

Main body 14 and cover 31 may be made from a material such as plastic and have side recess 131 and 132 formed therein. The pair of helical springs 20 and 21 rest on the upwardly facing surface of the bottom wall of main body 14 and contact the bottom surface of latch 17. Optional pins may be used to secure the main body 14 to cover 31 and extend upwardly through plate 30. A circumferentially extending channel may be formed in the upper edge portion of main body 14 to receive the edge of reinforcement plate 30 and a downwardly extending lip of cover 31 with the lip extending in a force fit relationship between the edge of reinforcement plate 30 and the top edge of cover 14, all as shown and described in U.S. Pat. No. 4,617,705.

Figure 7:
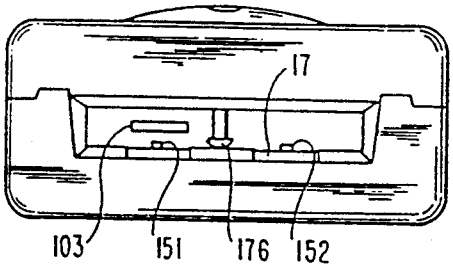
FIG. 7 is an end view of the buckle of FIG. 1 showing a single tongue inserted therein.
Figure 8:
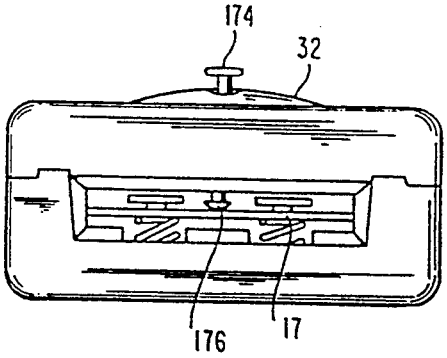
FIG. 8 is the same view as FIG. 7 only showing a pair of tongues inserted into the buckle.

Plate 30 has a forward edge with a pair of downwardly extending legs 94 and 95 in turn having, respectively, inwardly extending portions 88 and 89. Legs 94 and 95 are perpendicularly arranged to the plate and the distal ends which are parallel to the plate. The legs contact the upwardly facing surface of the bottom wall of housing 14 and support the plate there atop. The legs are formed from the leading edge of the plate leaving a center portion 90 positioned there between which contacts an upwardly extending boss 128 integrally formed with the bottom housing 14. Boss 128 extends upwardly to a downwardly extending projection of cover 31 dividing the mouth into a pair of mouths to receive the forwardly extending portions 103 and 104 of tongues 101 and 102. Boss 128 has not been shown in FIGS. 7 and 8 to enable a better depiction of the indicator bottom end.

Plate 30 includes a pair of apertures 51 and 52 aligned with cavities 24 and 25 to receive the downwardly extending button legs 53 and 54 which project through the plate and movable against the top surface of the latch. A third aperture 56 is formed rearwardly of edge 44 and is aligned with aperture 57 of main body 14 and a similarly located aperture 61 of cover 31 to allow a seat belt to be attached to the buckle. A plurality of apertures 58 are located around the peripheral portion of plate 30 to receive the pins which extend through the plate and into the main body 14 and cover 13 to provide additional strengthening means securing the cover plate and main body together.

Figure 6:
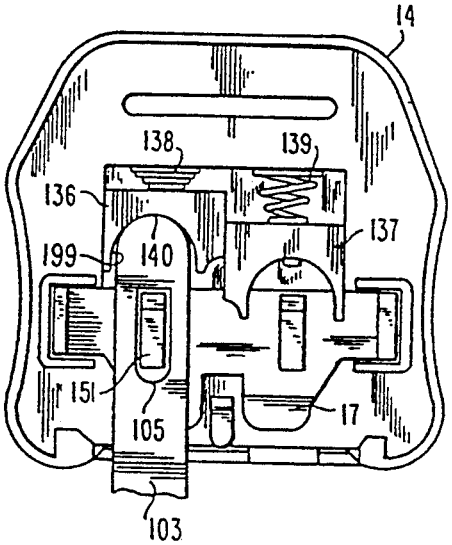
FIG. 6 is the same view as FIG. 5 only showing a single tongue inserted into the buckle.

A pair of concave cavities 134 and 135 are formed in the aft portion of cavity 15 being separated by an upraised portion 133 to receive a pair of horizontally extending wire springs 138 and 139. Both cavities 134 and 135 are tapered so that the smaller end of the cavities face forward to receive the complementary shaped tapered ends of wire springs 138 and 139. To insure the buckle will latch only when both tongues are inserted therein a pair of plastic anti-false latching members 136 and 137 are provided within cavity 15 being located between the rear edge 150 of latch 17 and the forward ends of springs 138 and 139. Members 136 and 137 have forwardly opening concave surfaces 144 and 145 to respectively engage the rounded distal ends of tongue bars 103 and 104. Each member 136 and 137 has a downwardly opening cavity 142 and 143 to receive, respectively, pins 140 and 141 which project upwardly from the bottom of cavity 15 thereby mountingly holding members 136 and 137 within the cavity. Each cavity 142 and 143 opens through, respectively, surfaces 144 and 145 to allow members 136 and 137 to slide horizontally backward compressing springs 138 and 139 when the tongues are fully inserted thereby contacting the surfaces 144 and 145. Likewise, when the tongue bars are withdrawn from the buckle, springs 138 and 139 force members 136 and 137 horizontally in the direction of the mouth of the buckle. Members 136 and 137 each have an outwardly located side extension 146 and 149 and center extensions 147 and 148 which normally project above the upper surface of latch 17 when tongue bars 103 and 104 are not inserted into the buckle. In the event a single tongue bar is inserted into the buckle, only a single member 136 or 137 moves rearwardly thereby allowing the remaining unmoved member to project over the latch and prevent the latch from engaging the inserted tongue bar. For example, in the event tongue bar 103 is inserted into cavity 15 while tongue bar 104 remains outwardly of the buckle, the rounded distal end 140 (FIG. 6) of tongue bar 103 will engage the downwardly beveled leg 153 of the latch eventually positioning aperture 105 immediately over projection 151. Simultaneously, tongue bar 103 will engage concave surface 144 and move member 136 rearwardly thereby moving projections 146 and 147 away from latch 17. Projections 148 and 149 of member 137, however, will remain above latch 17 preventing the latch from moving upwardly by the force of helical springs 20 and 21 and thereby preventing upraised latch portion 151 from entering opening 105. The upper edge 199 (FIG. 6) of concave surface 146 is located above the top surface of tongue bar 103.

Figure 4:
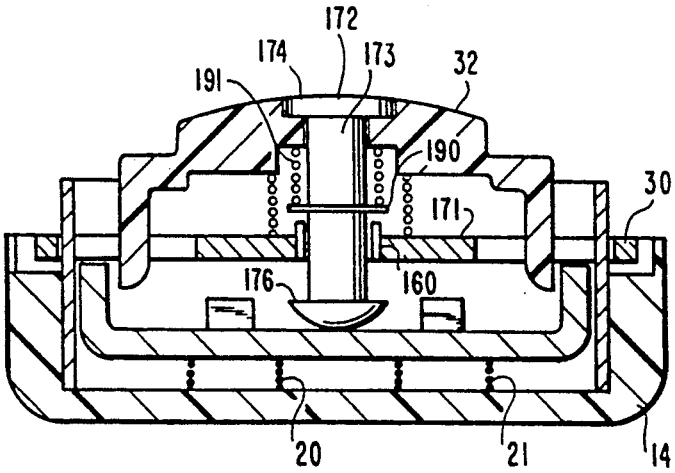
FIG. 4 is a cross-sectional view of the buckle of FIG. 1 with the upper housing removed therefrom.
Figure 5:
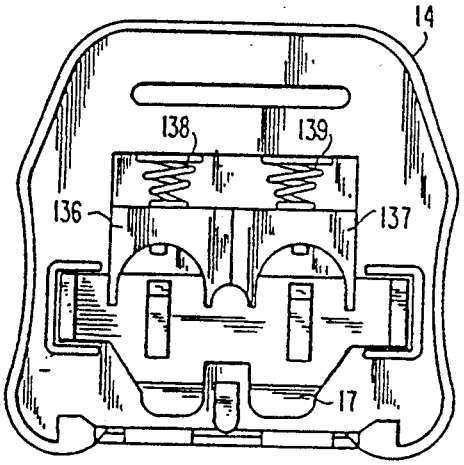
FIG. 5 is a top view of the buckle of FIG. 1 only with the reinforcement plate and portions there above removed to illustrate the position of the pawl.

The buckle push button is provided with an indicator for clearly illustrating when the buckle is lockingly engaged with both tongues. The central portion of button 32 (FIG. 4) is provided with a counter bored hole to receive indicator 172. The stem 173 of the indicator extends freely through button 32 and has a head 174 integrally formed thereon which is complementary received in the counter bore recess of the button aperture. The upper surface of head 174 is smoothly contoured to blend into the convex upwardly facing surface of button 32 when the button is in the retracted position corresponding to indicating the buckle is not lockingly engaged with both tongues. Stem 173 extends through a upwardly projecting sleeve 160 (FIG. 4) fixedly mounted to the center portion of upwardly facing surface 171 of reinforcement plate 30. Stem 173 projects through sleeve 160 and the reinforcement plate towards latch 17. An enlarged rounded bottom end 176 is mounted to stem 173. A projection, such as a washer 190 is fixedly mounted to stem 173 supporting a helical spring 191 there atop which has a top end engaging the bottom surface of button 32. Spring 191 is operable to urge button head 174 downwardly into the button counter bored recess, but is yieldable to allow the head 174 to extend above the button 32 once latch 17 moves upwardly to the latched condition thereby forcing bottom end 176 of the indicator upwardly. End 176 is larger than the inside diameter of sleeve 160 to prevent the indicator from escaping the buckle and may be affixed to stem 173 once the stem is inserted through sleeve 160. Center projections 147 and 148 (FIG. 1) have distal concave shaped ends forming a partial semicircular cavity to prevent any interference with bottom end 176 of the indicator. A pair of apertures 155 and 156 (FIG. 1) are provided to prevent interference between the plate, helical springs 138 and 139 and upraised latch portions 151 and 152.

When the tongue bars 103 and 104 are not inserted into the buckle, the top surface of indicator head 174 is flush with the upwardly facing surface of button 32. Once both tongue bars 103 and 104 are inserted into the buckle and are lockingly engaged with upraised latch portions 151 and 152, latch 17 moves to the upward position (FIG. 8) compressing spring 191 and moving stem 173 upward until head 174 projects above the upwardly facing surface of button 32. An indication is therefore provided that the buckle is lockingly engaged with the buckle tongues. To disengage the buckle with the tongues, buckle 32 is moved downwardly thereby forcing latch 17 downwardly disengaging the upraised latch portions with the tongue bars.

Buckle tongue 100 consists of two interlockable, but separable tongues 101 and 102 each having fixedly mounted thereto in cantilevered fashion tongue bars 103 and 104. Tongue bars have respectively D-shaped apertures 105 and 106 with the flat portion of the D-shaped hole being located adjacent the rounded distal ends of the tongue bar to engage the upraised latch portions 151 and 152. Tongue bars 103 and 104 are provided with upraised portions 114 and 115 adjacent their proximal ends with the upraised portions 114 and 115 being complementary shaped to fit into, respectively, recesses 129 and 130 formed in the top cover 31. Thus, if the tongue bars 103 and 104 are turned upside down, then upraised portions 114 and 115 will not fit into recesses 129 and 130, and instead will contact the outwardly facing surface of housing 14 adjacent the buckle mouth preventing full insertion of the tongue bars and thereby preventing engagement of recesses 105 and 106 with upraised latch portions 151 and 152.

Tongues 101 and 102 (FIGS. 2 and 3) have overlapping walls 117 and 116, respectively, which extend over and adjacent the other tongue. For example, tongue 101 includes wall 117 which extends outwardly of and adjacent tongue 102, whereas wall 116 integrally attached to tongue 102 extends outwardly and adjacent tongue 101. Walls 116 and 117 are provided, respectively, with projections 118 and 119 which fit into complementary sized apertures provided in the outwardly facing surface of each tongue. For example, tongue 101 includes aperture 120 which releasably receives projection 118 of wall 116. Likewise, projection 119 which extends upwardly from surface 121 of wall 117 extends into an aperture provided in the downwardly facing surface of tongue 102 as viewed in FIG. 2.

Figure 2:
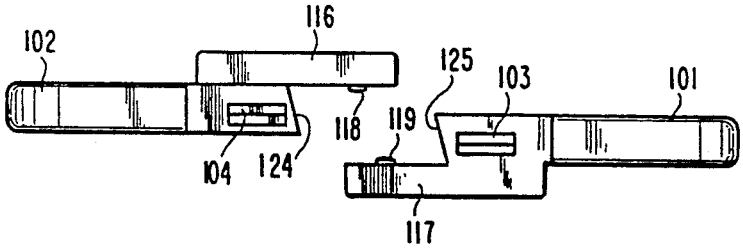
FIG. 2 is an end view of the tongue of FIG. 1 only showing the tongue separated into a pair of tongues.
Figure 3:
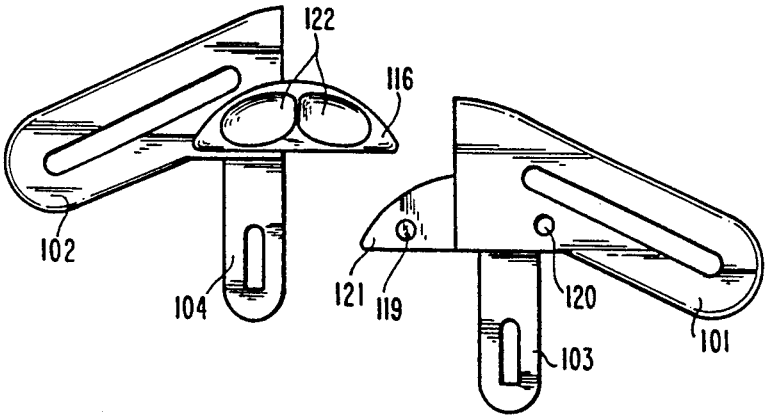
FIG. 3 is a top view of the tongues shown in FIG. 2 with the tongues being separated to fully illustrate the interlocking end portions.

The mutually facing surfaces 124 and 125 of tongues 102 and 101 are at an angle relative to the vertical axis as shown in FIG. 2 facilitating the sliding together of the tongues and the eventual extension of projections 118 and 119 into the adjacent apertures provided in the tongues.

Wall 116 integrally attached to tongue 102 has a downwardly facing surface with a pair of finger depressions 122. Likewise, wall 117 attached to tongue 101 has an upwardly facing surface 123 (FIG. 1) with a single thumb depression 111 formed therein enabling the user to grasp the pair of tongues by placing the user's thumb in depression 111 and the second and third fingers of the hand in depressions 122. A heart-shaped upraised portion 113 is formed on the upper surface of tongues 101 and 102 to provide an indication of which side of the tongues should face upwardly. Upraised portion 113 is divided in half along the tongue mating line 112 which is aligned with mating surfaces 124 and 125 of the tongues.

Figure 9:
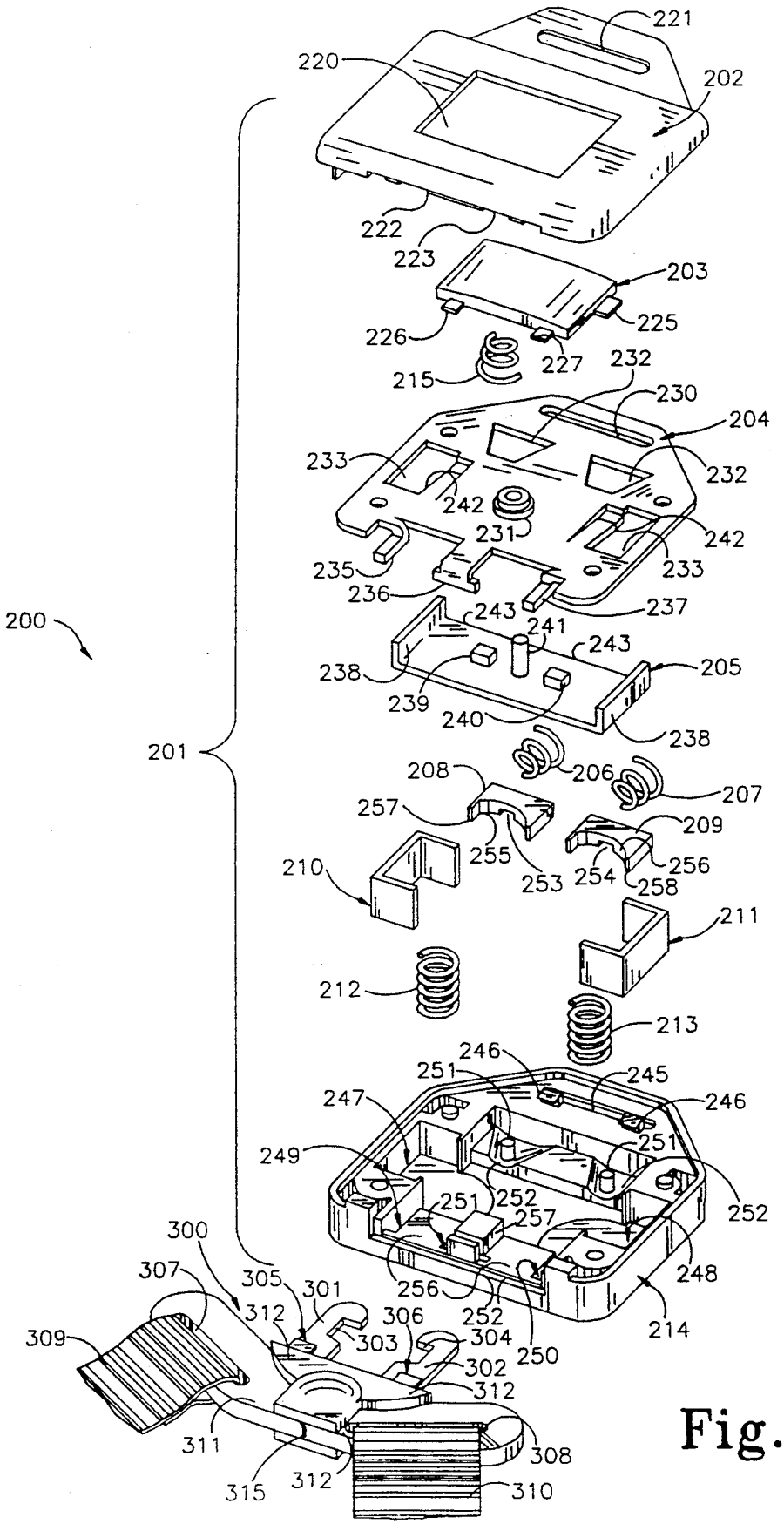
FIG. 9 an is exploded, perspective view of another buckle and tongue combination.

Referring now to FIG. 9, another alternate embodiment of the belt buckle with interlocking dual tongue 200 according to the present invention is shown. An exploded perspective view of the buckle 201 is shown in FIG. 9 detailing the component parts internal within buckle 201. The buckle 201 and dual tongue 300 include the anti-falsing latching function described in conjunction with the embodiment shown in FIGS. 1–8. The latching indicator of the previous embodiment is not included in the embodiment of FIG. 9. However, an improved latching pawl having a guide pin attached thereto is included in the embodiment of FIG. 9 to enhance the operation of and encourage smooth latching and unlatching of the buckle 201 and dual tongue 300.

Buckle 201 includes the following component parts: cover 202, push button 203, reinforcement plate 204, pawl or latch 205, anti-falsing latching members 208 and 209, channels 210 and 211, main body 214, and springs 215, 206, 207, 212 and 213.

Cover 202 includes an aperture 221 for receiving a web commonly used in a seat belt harness (not shown). Aperture 220 is shaped to receive push button 203 from the underside. Tabs 225 on the opposite sides and tabs 226 and 227 on the opposite ends of the push button contact the underside of cover 202 and retain push button 203 within aperture 220. Spring 215 is located over bushing 231 and upwardly biases push button 203 into aperture 220.

Reinforcement plate 204 includes aperture 230 which aligns with aperture 221 thereby allowing the web material to pass there through. Apertures 232 are designed to receive and retain springs 206 and 207 once springs 206 and 207 are positioned behind anti-falsing latching members 208 and 209, respectively, in channels 252 of main body 214. Apertures 233 are shaped to receive channels 210 and 211. Guide members 242, formed by shearing and bending portions of plate 204 provide lateral guides for tongue bars 301 and 302 when the bars are inserted into the buckle 201 along surfaces 256. Plate 204 includes locating tabs 235, 236 and 237 formed integrally with plate 204. Tabs 235, 236 and 237 are received in slots 249, 251 and 250, respectively, of main body 214 when plate 204 is positioned into main body 214.

Pawl 205 includes horizontal rising portions 238 sized to coincide with channels 210 and 211. Thus, pawl 205 can move vertically yet is restricted horizontally by channels 210 and 211. Locking tabs 239 and 240 coincide with and engage cutouts 303 and 304 of tongue bars 301 and 302, respectively, when pawl 205 is spring biased upwards by springs 212 and 213. In order for pawl 205 to move upwards within channels 210 and 211, anti-falsing latching members 208 and 209 must be horizontally moved by tongue bars 301 and 302 thereby allowing pawl 205 to move vertically. Members 208 and 209 are spring biased horizontally by springs 206 and 207, respectively. Pawl 205 is retained in an unlocked position by members 208 and 209 which physically engage pawl 205 and prevent movement of pawl 205 in a vertical direction. Essentially, the anti-falsing mechanism of this embodiment of the present invention functions identically as the buckle shown in FIGS. 1–8. Pawl 205 also includes guide pin 241 which is press fitted into pawl 205. Pin 241 extends upwardly through bushing 231 so that push button 203 may contact pin 241 thereby moving pawl 205 downward to unlatch the buckle 201 and tongue 300. Guide pin 241 prevents pawl 205 from assuming a position which is askew from the plane of the plate 204. Thus, latching and unlatching of the individual tongue bars 301 and 302 occurs simultaneously as a result of the well defined linear movement of pawl 205 in the direction of the cylindrical axis of the guide pin 241 retained and guided by bushing 231.

Main body 214 includes cavities 247 and 248 for receiving channels 210 and 211, locating pins 251 and cavities 252 for receiving springs 206 and 207. Pins 251 coincide with slots 253 and 254 to limit horizontal movement of members 208 and 209. The front or leading edge 257 and 258 of members 208 and 209, respectively, engages pawl 205 to prevent movement of pawl 205 when members 208 and 209 are spring biased toward the tongue 300 over the upper rear edge 243 of pawl 205 and pawl 205 is lowered as a result of operator depression of push button 203 into an unlatched position.

Clips 246, integrally molded with main body 214, provide a latching mechanism to hold plate 204 within main body 214. Clips 246 pass through aperture 230 of plate 204 and retain plate 204 in position.

When positioned in the main body 214, plate 204 provides a channel defined by tabs 235 and 237 in conjunction with surfaces 256 and 257 into which tongue bars 301 and 302 are inserted. Bevelled edge 252 assists in guiding tongue bars 301 and 302 into the appropriate apertures of buckle 201. Aperture 245 of main body 214 aligns with apertures 230 and 221 to allow webbing to pass there through.

Upon insertion into the belt buckle, the forward rounded distal ends of tongue bars 301 and 302 engage concave surfaces 255 and 256 of members 208 and 209, respectively, and move members 208 and 209 rearwardly into the main body 214. Once members 208 and 209 are moved by tongue bars 301 and 302, pawl 205 is released from the unlatched position thus enabling pawl 205 to move upwards as a result of forces from springs 212 and 213 within channels 210 and 211. Upon rising upwards, tabs 239 and 240 will engage cutouts 303 and 304, respectively, thereby retaining the dual tongue assembly 300 in the buckle 201. As with the previously described embodiment, unless both members 208 and 209 are simultaneously engaged by both tongue bars 301 and 302, the anti-falsing latching members retain pawl 205 in the unlatched position and springs 206 and 207 act to eject any inserted tongue bar.

Web 309 is received within aperture 307 of tongue portion 311. Web 310 is received in aperture 308 of tongue portion 312. Tongue 311 resides in a U-channel 315 formed or molded into tongue 312. Tongue guides 305 and 306 mate with and are received in apertures 222 and 223 of cover 202 so that the dual tongue 300 cannot be inverted or rotated 180 degrees and inserted into the buckle 201.

Cover 202, push button 203, and main body 214 can be formed or manufactured using plastic materials. Reinforcement plate 204 is preferably made of steel or other metal suitable for providing strong reinforcing strength. Pawl 205 and locating pin 241 are made of steel or other suitable material. Bushing 231 is made of nylon. Channels 210 and 211 are made of metal. Anti-falsing latching members 208 and 209 may be made of plastic, nylon or other suitable material.

Dual tongue 300 includes two metallic portions comprising the tongue bars 301 and 302, respectively. Cutouts 303 and 304 receive pins 239 and 240, respectively, of pawl 205 when the tongue 300 is inserted into the buckle 201 and the buckle latches onto the tongue and retains it therein until released by a depression of push button 203. Cutouts 303 and 304 are symmetrically opposed narrowed portions of tongue bars 301 and 302, respectively, wherein the tongue bars are approximately one half their broadest width. One edge of each cutout, 303 and 304, is formed along a line which is perpendicular to the direction of insertion of the tongue into the buckle, thereby providing a surface for pins 239 and 240 to act against for applying a retaining force to the tongue bars 301 and 302 when the buckle latches. Guide members 306 and 305 which prevent inversion of the tongue when inserted into the buckle 201.

Figure 10A:
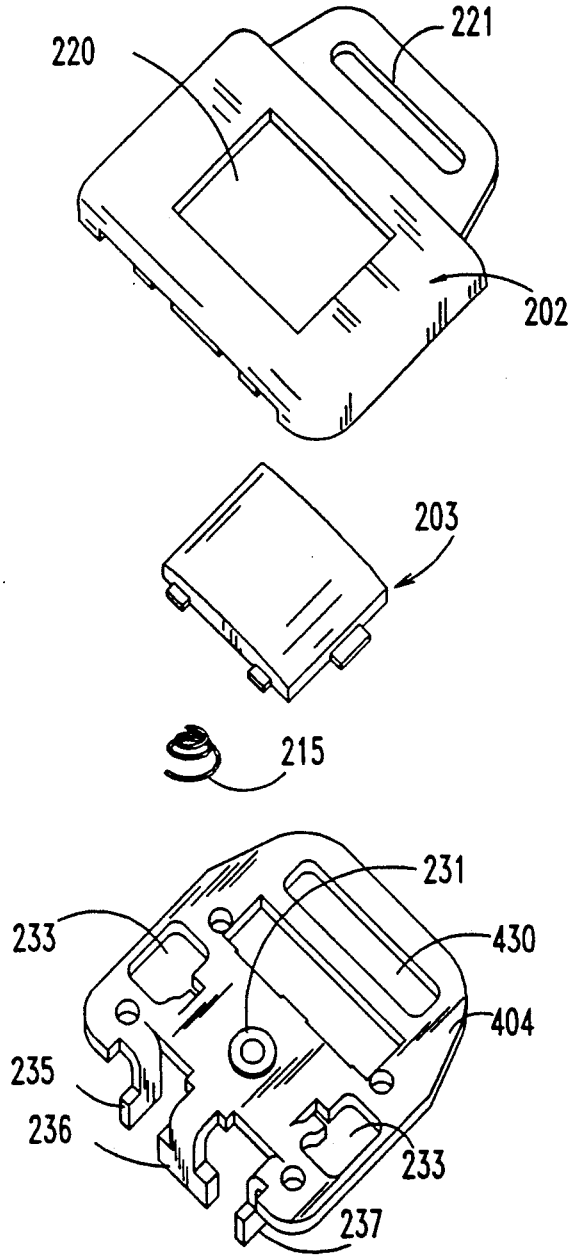
FIGS. 10A and 10B form together an exploded perspective view of still another buckle and tongue combination.
Figure 10B:
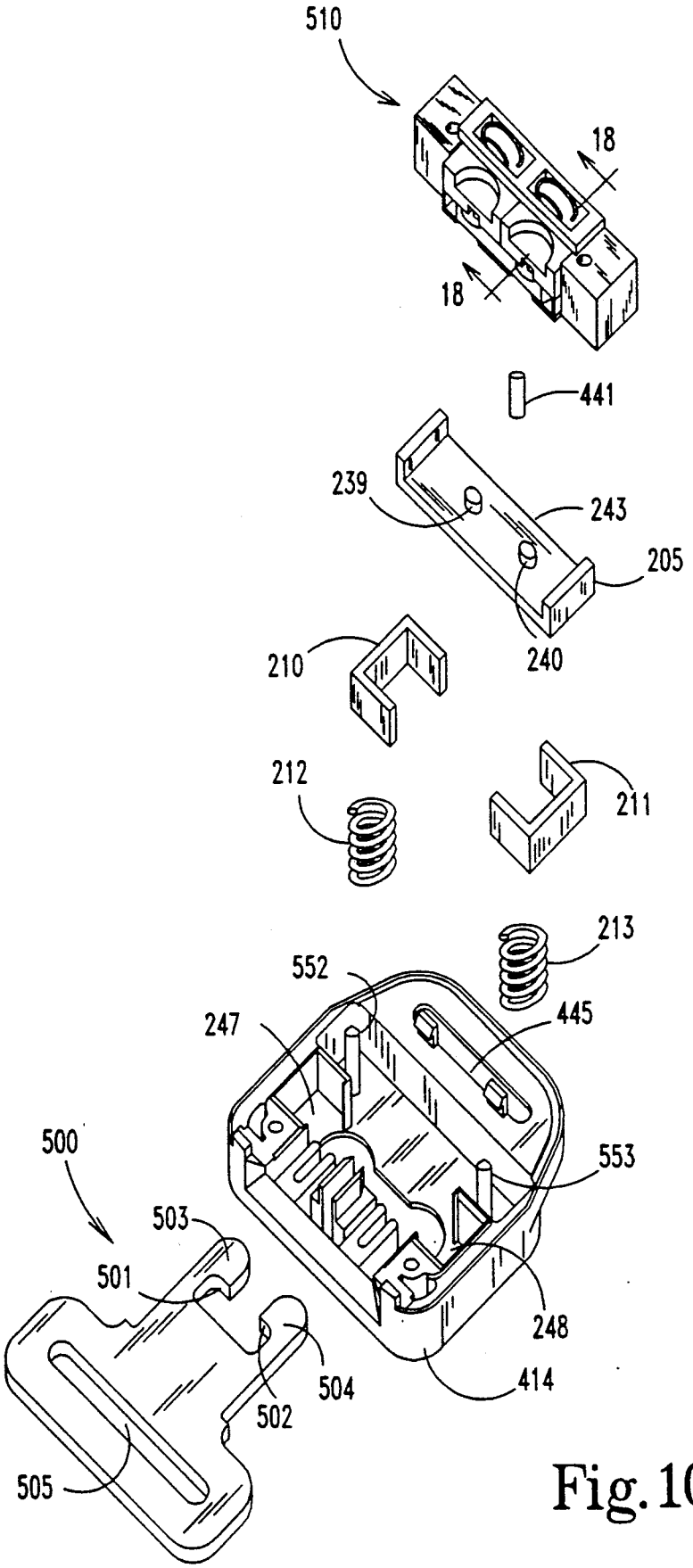

Another embodiment of the buckle-tongue combination incorporating an aspect of the present invention is shown in FIGS. 10A and 10B and is identical to the alternate embodiment as shown in FIG. 9 with the exception that the anti-falsing latching members or tongue ejectors 208 and 209 (FIG. 9) have been preassembled along with springs 206 and 207 into a housing with the entire housing assembly then being inserted as a unit into the buckle main body. In addition, the embodiment shown in FIGS. 10A and 10B includes a single tongue with a pair of outwardly extending tongue bars which are latched or ejected relative to the buckle in the same manner as that described for the pair of tongues shown in the embodiment of FIG. 9. While the embodiment is depicted as having only a single tongue with a pair of tongue bars it is to be understood that the buckle may operate equally well and in the same manner with a pair of tongues. Since an ejector module assembly is utilized to house the anti-falsing latching or ejector members, the pair of apertures 232 (FIG. 9) provided in the reinforcement plate 204 have been replaced with a single larger aperture. Further, pin 241 (FIG. 9) is not attached to the pawl in this embodiment and instead peg 441 floats between the pawl and the push button. The drawing of this embodiment has been split into FIGS. 10A and 10B to more clearly depict the buckle.

Referring now, more particularly to FIGS. 10A and 10B, there is shown an exploded perspective view of the embodiment of the belt buckle with tongue incorporating the ejector module assembly. The combination includes a single tongue 500 lockingly engageable with buckle 414. The buckle is identical to buckle 201 with the prior described exceptions. Thus, the identical components of FIGS. 9 and 10A and 10B are identified by the same component numbers and will not be further described, it being understood that the description of the alternate embodiment of FIG. 9 is applicable to those same components of FIGS. 10A and 10B. Thus, cover 202 includes an aperture 220 for push button 203 to extend therethrough to allow the operator to depress push button 203 normally urged upwardly by helical spring 215. Depression of button 203 results in downward movement of peg 441 which extends through bushing 231 mounted to reinforcement plate 404. Peg 441 may be fixedly mounted atop pawl 205 which is located beneath plate 404 within the main body cavity of buckle 414. Alternatively and as depicted in FIG. 10, peg 441 may rest atop pawl 205 and therefore is not physically attached to the pawl. The peg therefore floats and extends freely through and slidable within bushing 231 allowing the bushing to guide the peg in a straight line along the pegs longitudinal axis and preventing the peg from binding within the bushing in the event the pawl moves along a slightly askewed line.

Pawl 205 includes the previously described upwardly extending arms which are slidably received in channels 210 and 211 received within cavities 247 and 248 of the buckle main body. The helical springs 212 and 213 are positioned within the buckle main body beneath pawl 205 and urge the pawl upwardly so the projections 239 and 240 engage the mutually facing cut out portions 501 and 502 provided in the distal ends 503 and 504 of the conventional tongue 500. The tongue includes an aperture 505 through which a web may be secured. A similar aperture 221 in cover 202 is aligned with aperture 430 of plate 404 and aperture 445 of the buckle main body to allow a second web to be secured thereto. Reinforcement plate 404 is mounted to buckle main body 414 along with cover 202 in a manner identical to that described for the buckle tongue combination depicted in FIG. 9. Likewise, plate 404 includes the same downwardly extending legs 235, 236 and 237 along with apertures 233 as shown for plate 204 in FIG. 9.

Ejector module assembly 510 includes a pair of spring biased outwardly projecting members for engaging the distal ends 503 and 504 of tongue 500 to eject the tongue from the buckle main body when not latched to pawl 205. Likewise, the ejector members extend over the edge 243 of pawl 205 to retain the pawl downwardly until both distal ends 503 and 504 of the tongue are extended completely into the buckle main body thereby moving the ejectors apart from the pawl and preventing the pawl from being possibly skewed and latching only a single recess 501 and 502. The ejector members therefore provide a false latching means.

Figure 13:
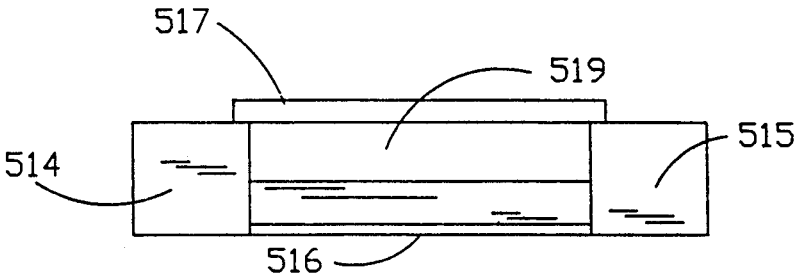
FIG. 13 is a front view of the housing of FIG. 11.
Figure 14:
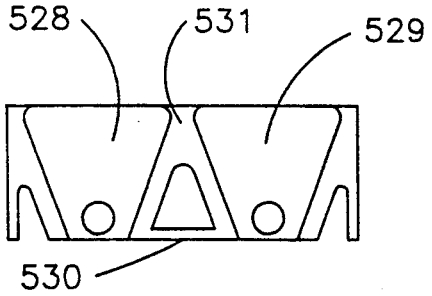
FIG. 14 is a top view of the spring seat insertable into the housing of FIG. 11.

Ejector module assembly 510 includes a housing 511 (FIG. 11) for holding the tongue ejector members 512 and 513 (FIG. 16) along with a pair of helical springs located rearwardly of the ejector members. Housing 511 includes a pair of end posts 514 and 515 (FIG. 13) integrally joined to a bottom wall 516 and a top wall 517. Bottom wall 516 has a downwardly facing surface co-planar with the bottom surfaces of posts 514 and 515 whereas top wall 517 is positioned atop the upwardly facing surfaces of posts 514 and 515.

Figure 15:
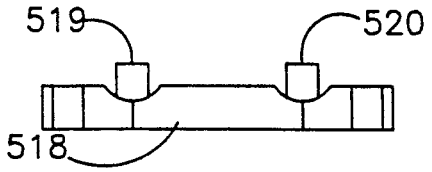
FIG. 15 is a front view of the seat of FIG. 14.
Figure 17:
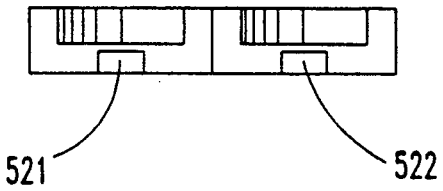
FIG. 17 is a front view of the members of FIG. 16.
Figure 18:
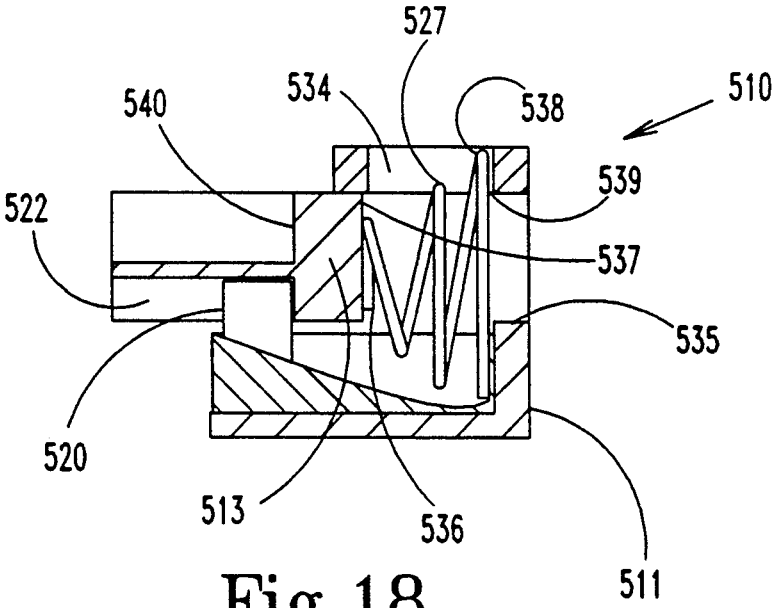
FIG. 18 is a cross sectional view of the ejector module assembly taken along the line 18—18 of FIG. 10B and viewed in the direction of the arrows.
Figure 19:
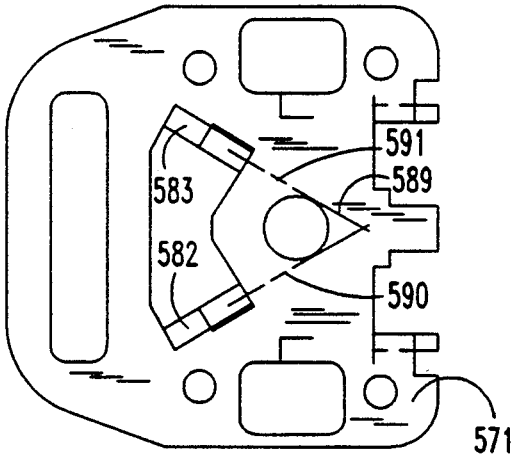
FIG. 19 is a top plan view of a reinforcement plate to be mounted to the buckle main body of FIG. 20.
Figure 20:
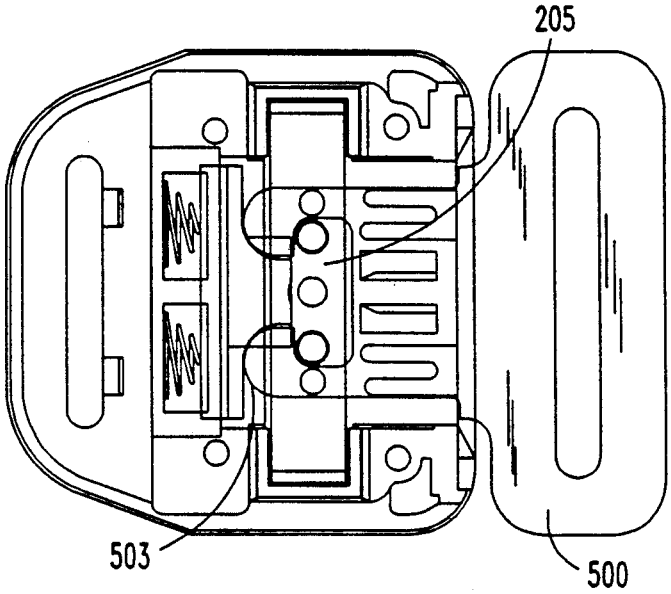
FIG. 20 is a top plan view of a first alternate embodiment of the buckle main body of FIGS. 10A and 10B with the top cover and reinforcement plate removed.
Figure 21:
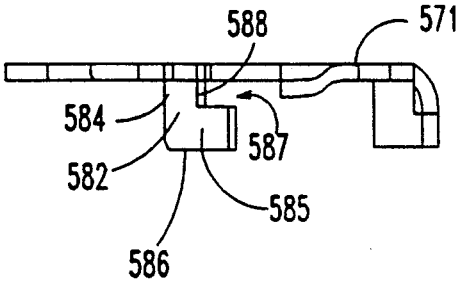
FIG. 21 is a side view of the plate of FIG. 19.
Figure 22:
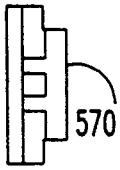
FIG. 22 is an end view of the ejector unitary member of FIG. 23.
Figure 23:
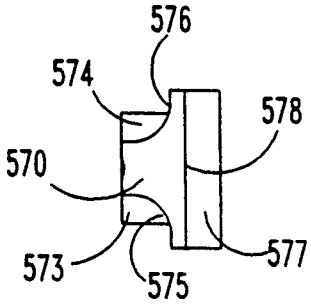
FIG. 23 is a top plan view of the ejector unitary member slidably mounted in the ejector module within the buckle main body of FIG. 20.

An intermediate member 518 (FIG. 15) is fixedly secured atop bottom wall 516 by pins or other suitable means and is located within the cavity 519 formed between bottom wall 516 and 517. A pair of pegs 519 and 520 are integrally attached to intermediate member 518 and project upwardly into respectively grooves 521 and 522 (FIG. 17) formed in the bottom surfaces respectively of tongue ejector members 512 and 513. Grooves 521 and 522 open outwardly through respectively the leading edges 523 and 524 of the two ejector members; however, grooves 521 and 522 terminate respectively intermediate front edge 523 and rear edge 525 of member 512 and front edge 524 and rear edge 526 of member 513. Thus, tongue ejector members 512 and 513 are allowed to extend partially outward from housing 511 as depicted in FIG. 18 due to the contact between pegs 519 and 520 and the end of grooves 521 and 522.

A pair of concave recesses 528 and 529 are formed in the upwardly facing surface of intermediate member 518 with each recess expanding in width and depth as each recess extends from the front edge 530 of the intermediate member to the rear edge 531. A pair of helical springs are positioned within recesses 528 and 529 with the smaller tapered ends of the springs contacting the rear edges 525 and 526 of members 512 and 513 urging the members outwardly. One such helical spring 527 is positioned between the rear edge of member 513 and the rear wall of housing 511.

Housing 511 includes an opening 532 (FIG. 12) formed in the rearwardly facing surface of the housing to allow members 512 and 513 to initially be inserted there through and installed atop intermediate member 518 thereby positioning pegs 519 and 520 within grooves 521 and 522. The back wall of housing 511 protrudes upwardly at the bottom of opening 532 forming a lip 535 (FIG. 18). Further, top wall 517 includes a pair of openings 533 and 534 (FIG. 11) through which a pair of helical springs may be inserted into the housing to be positioned between the rearward facing surface of each member 512 and 513 and the forward facing surface of lip 535 and the rear edge of wall 517 surrounding openings 533 and 534. For example, helical spring 527 (FIG. 18) is inserted through opening 534 thereby positioning the tapered small end 536 of the spring adjacent the rearward surface 537 of member 513 whereas the larger diametered end 538 of helical spring 527 rests against lip 535 and the forward facing surface 539 of top wall 517 located aft of opening 534.

Tongue ejector members 512 and 513 include recessed top surfaces 542 and 543 (FIG. 16) defined by concave surfaces 540 and 541 extending perpendicularly from surfaces 542 and 543 to engage the distal ends 503 and 504 of tongue 500. Tongue ejector members 512 and 513 normally project outwardly of the housing so as to overlap the rear edge 243 of pawl 205 retaining the pawl in a downward position when the tongue is not inserted into the buckle. Once the tongue is inserted into the buckle and distal ends 503 and 504 engage surfaces 540 and 541, the tongue ejector members are forced rearwardly with the helical springs 527 compressing thereby moving the tongue ejector members apart from pawl 205 and allowing projections 239 and 240 of the pawl to engage recesses 501 and 502 of the tongue. Once push button 203 is depressed, the pawl is moved downwardly thereby disengaging projections 239 and 240 from the tongues and locating the pawl beneath tongue ejector members 512 and 513 which are then urged outwardly by the helical springs to eject the tongue from the buckle.

Ejector module assembly 511 may be preassembled prior to insertion into the buckle main body by first inserting intermediate member 518 into housing member 511 and then inserting tongue ejector members 512 and 513 along with the pair of helical springs into the housing. The entire ejector module assembly may then be manually or automatically via machine inserted to the buckle main body. A pair of holes 550 and 551 (FIG. 11) are provided in posts 514 and 515 allowing the ejector module assembly to be installed onto pegs 552 and 553 (FIG. 10B) which extend respectively through holes 550 and 551. Both pegs extend upwardly from the cavity formed in buckle main body 414. The ejector module assembly provides a false latching means which is operable to allow pawl 205 to lockingly engage tongue 500 when the tongue is inserted completely into the buckle main body and not cocked relative to the pawl. In the event the pawl and tongue are cocked relative to each other, then both tongue ejector members 512 and 513 will not be completely depressed into ejector housing 511 thereby ensuring at least one member retains a portion of the pawl in the downward position preventing the pawl from latching to the tongue. This is particularly true when a pair of tongues as depicted in FIG. 9 are inserted into buckle 414 in lieu of a single tongue 500. Thus, assuming a single tongue bar 301 (FIG. 9) is inserted into buckle 414 thereby depressing member 512, the remaining tongue ejector member 513 will remain stationary over pawl 205 retaining the pawl in the downward position and preventing the pawl from latching to tongue bar 301 until tongue bar 302 is inserted into the buckle thereby moving tongue ejector member 513 rearwardly and apart from the pawl. Thus, the present invention includes utilizing buckle 414 not only with a unitary tongue 500 but also a pair of tongues.

An alternate embodiment depicted in FIGS. 19–23 is identical to the embodiment of FIG. 10 with the exception that the pair of tongue ejector members 512 and 513 have been replaced by a single tongue ejector 570 (FIG. 22) and with a further exception that reinforcement plate 571 includes a pair of downwardly extending legs 582 and 583 forming guides and stop surfaces for the distal ends of tongue 500.

Figure 11:
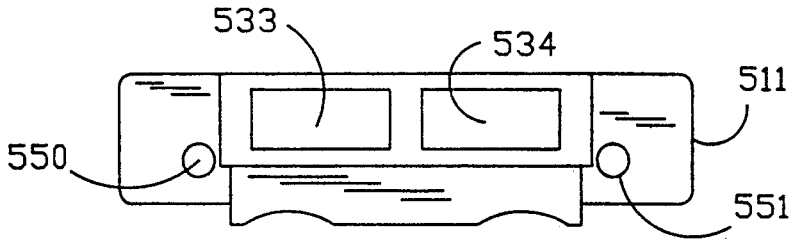
FIG. 11 is an enlarged top view of the ejector housing.
Figure 12:
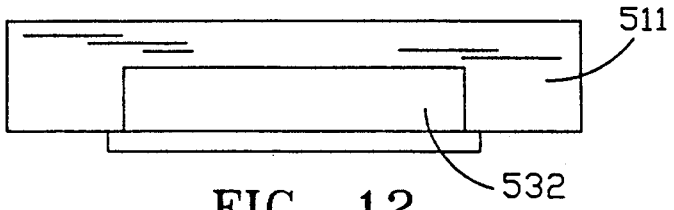
FIG. 12 is a rear view of the housing of FIG. 11.
Figure 16:
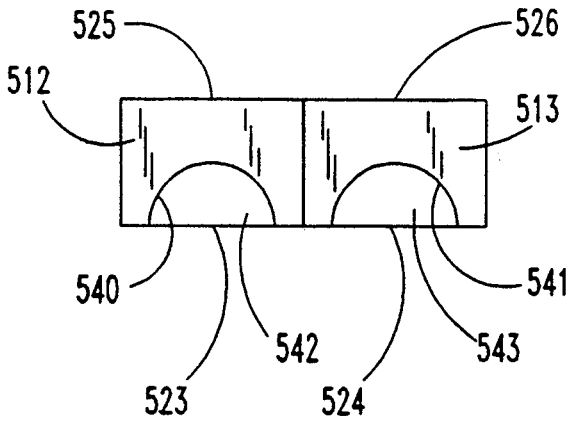
FIG. 16 is a top view of the ejector members.

Tongue ejector member 570 includes a pair of depressed surfaces 573 and 574 (FIG. 23) with concave surfaces 575 and 576 extending perpendicularly upwardly therefrom. Surfaces 573–576 provide the same function as surfaces 540–543 (FIG. 16). That is, the distal ends of tongue 500 when inserted into the buckle rest atop surfaces 573 and 574 and engage concave surfaces 575 and 576 forcing the tongue ejector member rearwardly off of and apart from the pawl 205 (FIG. 20) allowing the pawl to lockingly engage the tongue. A recess 577 is formed in the top rear edge of tongue ejector member 570 forming a surface 578 extending perpendicularly upward from the bottom surface of the recess 577 and providing a seat for the small diameter end of a pair of helical springs resting within recess 577. The larger diameter ends of the pair of helical springs contact the rear surface of openings 533 and 534 (FIG. 11). For example, one helical spring is positioned between surface 578 and surface 539 of opening 534 whereas the second helical spring is positioned between surface 578 and the surface of top wall 517 surrounding the rear portion of opening 533. Thus, the helical springs urge tongue member 570 outwardly atop the pawl to engage the distal ends of tongue 500. Tongue ejector member 570 likewise includes a pair of grooves to receive the upwardly projecting pegs 519 and 520 of intermediate member 518 positioned atop the bottom wall of housing 511. Thus, the ejector module assembly utilized with the single tongue ejector 570 is identical to the ejector module of FIG. 18 with the exception that the pair of tongue ejector members have been replaced by a single tongue ejector member.

A pair of downwardly extending legs 582 and 583 are integrally attached to reinforcement plate 571 and rest atop the bottom surface extending across the main cavity of the buckle main body. The distal end of each leg extends forwardly forming a recess into which the distal end of tongue 500 is positioned.

Leg 582 will now be described it being understood that a similar description applies to leg 583. Leg 582 (FIG. 21) includes a downwardly extending portion 584 integrally joined at a right angle to a forwardly extending portion 585. The bottom surface 586 of portion 585 rests atop the bottom surface of the main cavity of the buckle main body. Portion 585 is spaced apart from the main body of the reinforcement plate 571 forming a recess 587 into which the distal end 503 of tongue 500 is inserted. Likewise, the edge surface 588 of the downwardly extending portion 584 which faces forwardly defining the back boundary of recess 587 provides a stop surface for engaging the tongue distal end. Legs 582 and 583 are angularly positioned relative to the insertion axis of the tongue. That is, the longitudinal axis 590 and 591 (FIG. 19) extending respectively through the lengths of bottom portions 585 of the two legs 582 and 583 form an included angle 589 of approximately 45 degrees thereby positioning each stop surface 588 of legs 582 and 583 toward the outer edge respectively of distal ends 503 and 504 of the tongue in order to center the tongue as it is inserted into the buckle relative to pawl 205. The distal ends of the tongue when fully inserted are thereby positioned between the main body of reinforcement plate 571 and the forwardly extending lower portions 585 of legs 582 and 583 limiting pivotal motion of the tongue relative to the buckle. That is, in the event the web attached to tongue 500 is pulled downwardly relative to the buckle to urge distal ends 503 and 504 of the tongue upwardly, the distal ends will contact the downwardly facing surface of reinforcement plate 571 thereby limiting further pivotal motion of the tongue. Likewise, in the event the web attached to tongue 500 is pulled upwardly relative to the buckle to force the distal ends of the tongue against portions 585 of tongues 582 and 583 then further upward movement of the web will be limited preventing pivotal motion of the tongue relative to the buckle.

Figure 24:
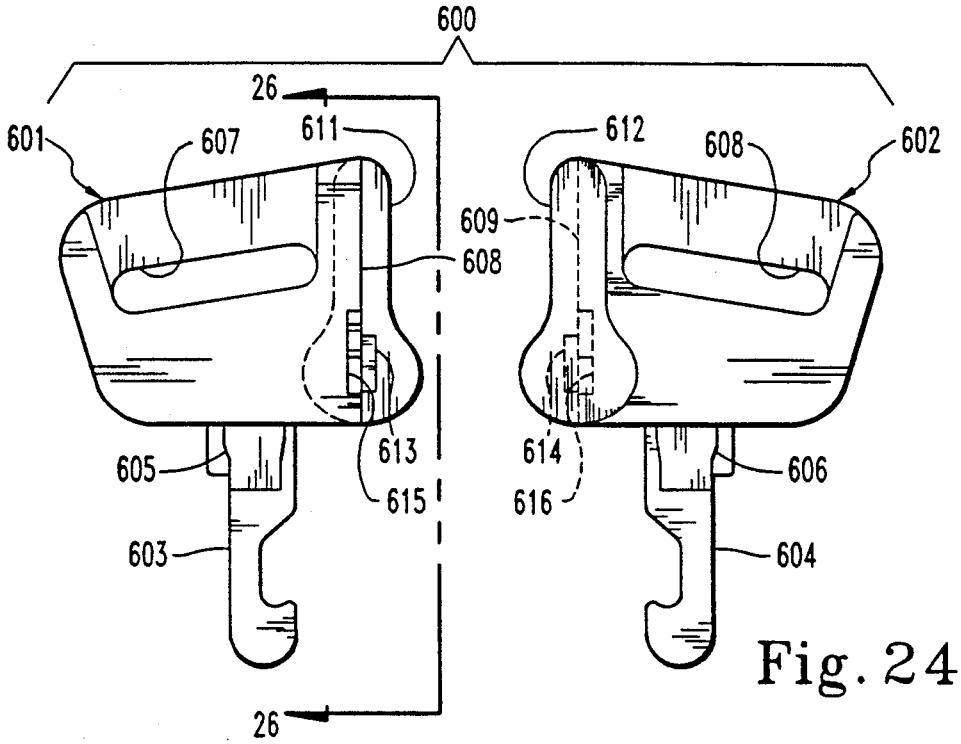
FIG. 24 is a top plan view of a pair of interactive dual tongues according to the preferred embodiment of the present invention.
Figure 25:
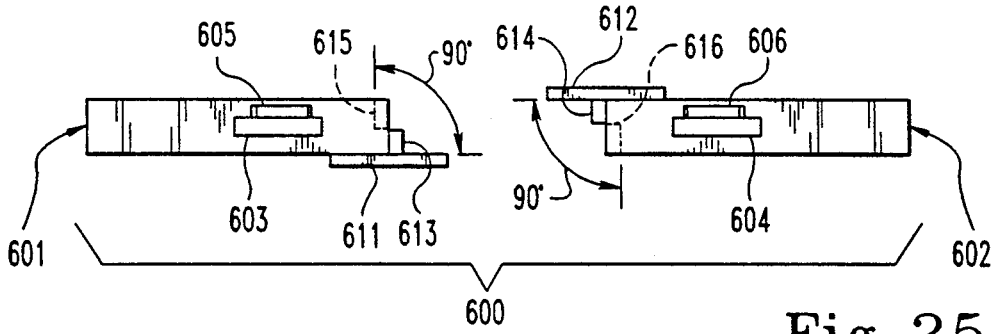
FIG. 25 is a front elevational view of the pair of dual tongues shown in FIG. 24.

Referring now to FIGS. 24 and 25, a pair of dual interactive tongues 600 according to the preferred embodiment of the present invention are shown. Dual interactive tongues 600 are similar to the tongues 100 and 300 described earlier except that dual tongues 600 include interactive engaging features rather than the mating features of tongue 300 or the fully interlocking features of tongue 100. Although not readily apparent, both individual tongues 601 and 602 are substantially identical except that tongue 601 includes a guide member 605 on one side of its tongue bar 603, whereas guide member 606 of tongue 602 is positioned on the opposite side of its tongue bar 604. In other words, tongues 601 and 602 are mirror images of one another and are virtually identical except for the relative positioning of guide members 605 and 606. Tongues 601 and 602 are similar to the tongues described earlier in that both include a web aperture 607 and 608, respectively.

Figure 26:
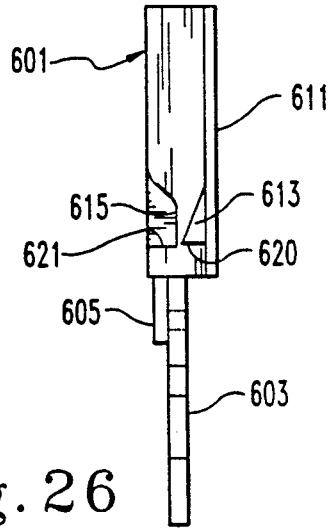
FIG. 26 is a right side elevational view of one of the tongues of the present invention looking along arrows 26—26 of FIG. 24.

When tongues 601 and 602 are meshed, planar surface 608 lies in contact with planar surface 609 and flange 611 overlies a portion of tongue 602 while flange 612 overlies a portion of tongue 601. Flanges 611 and 612 serve to inhibit tongues 601 and 602 from relative lateral movement when in close proximity to one another. Tongue 601 includes a small wedge-shaped projection 613 that is positioned at the corner interface of planar surface 608 and flange 611, as best shown in FIG. 26. When tongue 601 and 602 are meshed, wedge-shaped projection 613 is positioned within indentation 616 of tongue 602. Likewise, an identical wedge-shaped projection 614 on tongue 602 is received within indentation 615 of tongue 601 when the two tongues are meshed together. The shape and positioning of these interactive features enables the two tongues to easily mesh when moved toward each other anywhere within the complementary 90° arcs illustrated in FIG. 25. This enables the two tongues to easily slip into meshed engagement when slid against one another along a direction defined by the tongue bar 603 or 604.

Figure 27:
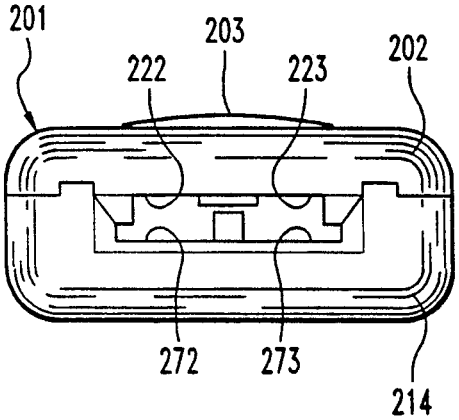
FIG. 27 is an assembled front elevational view of the belt buckle illustrated in FIGS. 9 or 10A and B.

As discussed with regard to the previously described tongues, guide member 605 ensures that tongue 601 can only be inserted into slot 273 (FIG. 27) of buckle 201 in an upright position so that guide member 605 is received within aperture 223. Likewise, guide member 606 of tongue 602 must be received within aperture 222 in order for tongue bar 604 to be completely inserted into slot 272 of the belt buckle. As illustrated in FIG. 27, when belt buckle 201 is assembled, a pair of adjacent slots 272 and 273 are shaped to slidingly receive tongue bars 604 and 603, respectively. Slots 272 and 273 are configured in order to force tongues 601 and 602 into meshed engagement when the tongues are advanced into belt buckle 201. These interactive features facilitate the latching of the tongues to the belt buckle because the two tongues are forced to move simultaneously after their interactive features come into engagement.

Figure 28:
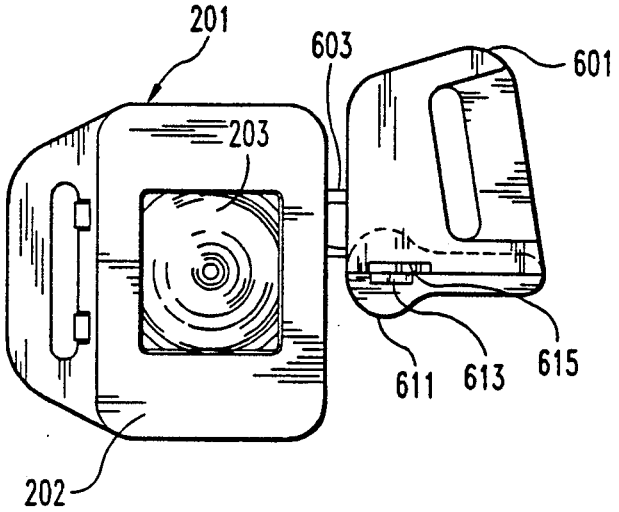
FIG. 28 is a top view of the belt buckle of FIG. 27 with the tongue illustrated in FIG. 26 partially inserted therein.
Figure 29:
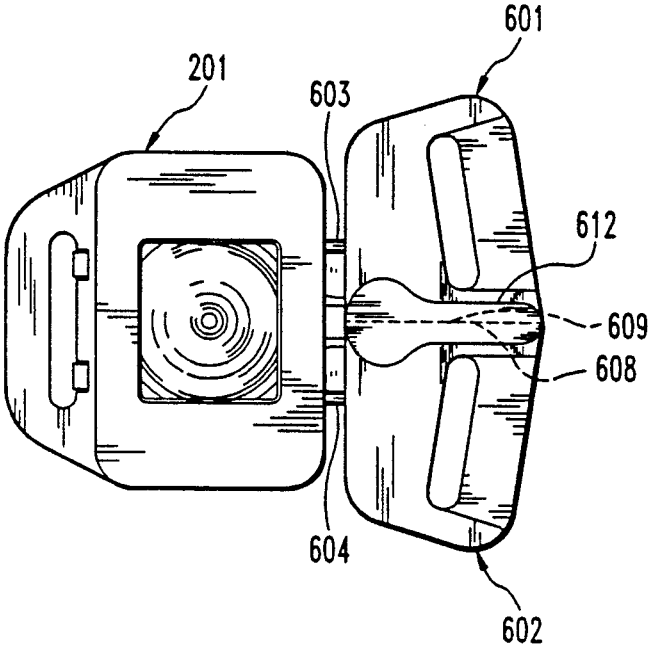
FIG. 29 is a top view similar to FIG. 28 except showing the second tongue also inserted into the buckle.
Figure 30:
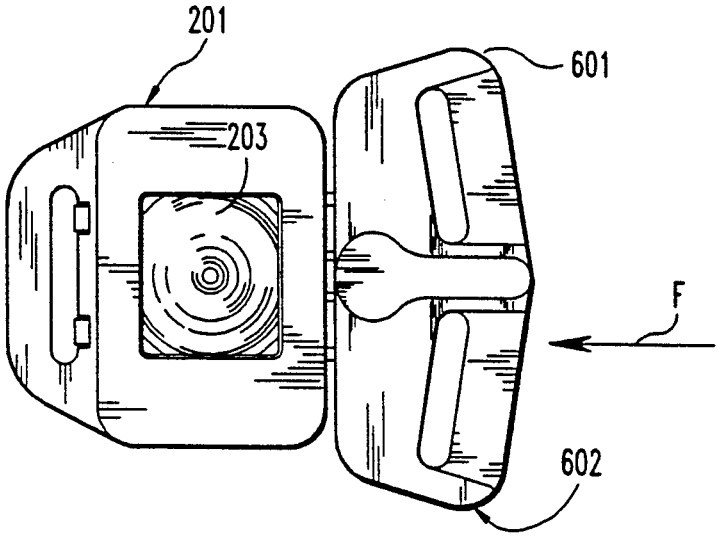
FIG. 30 is a top view similar to FIGS. 28 and 29 except showing the dual interactive tongues fully inserted into the belt buckle and secured thereto.

FIG. 28 shows tongue bar 603 of tongue 601 partially inserted into belt buckle 201. As discussed earlier, the false latching features of the belt buckle prevent the latching mechanism from triggering when only a single buckle tongue is inserted into the buckle. Furthermore, the latching mechanism of belt buckle 201 will only trigger when both buckle tongues are simultaneously fully inserted into the belt buckle. FIG. 29 shows the buckle-tongue combination after tongue 602 has also been partially advanced into the belt buckle until the interactive features of both tongues have meshed into engagement and planar surfaces 608 and 609 have come into contact. In other words, as tongue 602 is advanced into the belt buckle, the configuration of slots 272 and 273 force wedge-shaped projections 613 and 614 to slide into their respective counterpart indentations 616 and 615, respectively. After the two tongues become meshed as shown in FIG. 29, one need only push on one of the tongues in order to simultaneously advance the two tongues into the belt buckle in order to trigger the latching mechanism previously described. For instance, when tongue 602 is pushed into buckle 201 as shown in FIG. 30, the leading edge 620 of wedge 614 rests against and pushes the front wall 621 of indentation 615 in order to push tongue 601 simultaneously with tongue 602. As shown in FIG. 26, both the leading edge 620 of the wedge-shaped projection 613 and the front wall 621 of indentation 615 are substantially planar and lie perpendicular to an axis defined by tongue bar 603. Of course, it is to be understood that that a myriad of different shaped interactive features could be used in place of the wedge-shaped projections and indentations shown and described, without any degradation in performance.

Figure 31:
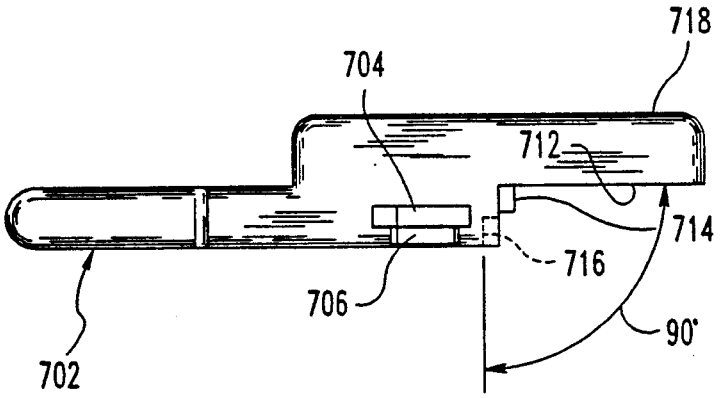
FIG. 31 is a front elevational view of one of a pair of dual interactive tongues according to another embodiment of the present invention.
Figure 32:
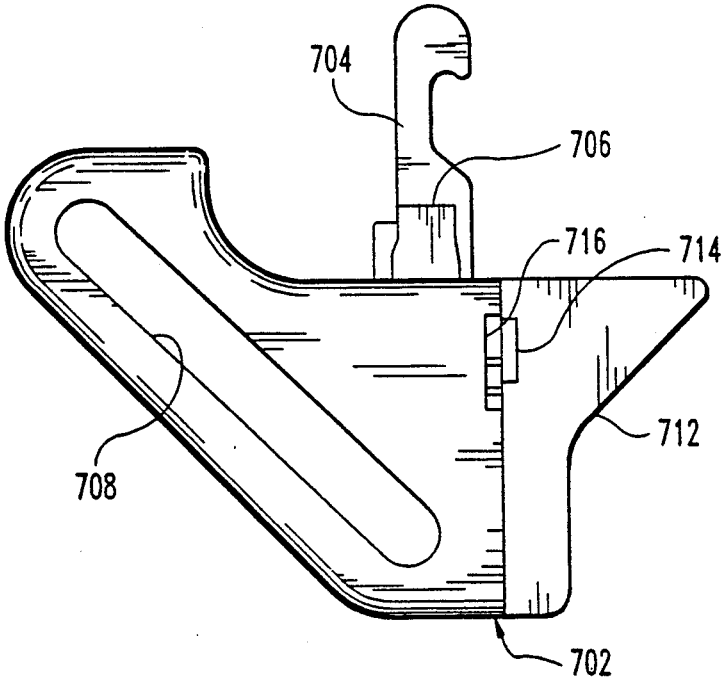
FIG. 32 is a top plan view of the tongue of FIG. 31.
Figure 33:
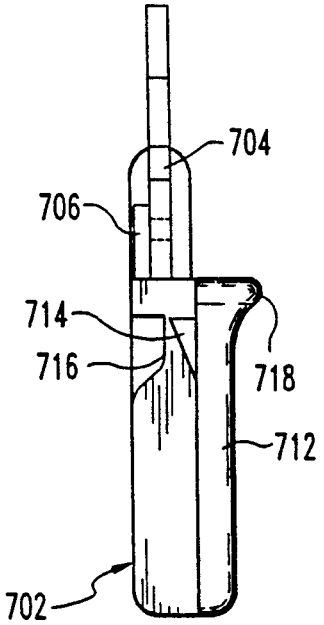
FIG. 33 is a right side elevational view of the tongue shown in FIGS. 31 and 32.

FIGS. 31–33 illustrate another embodiment of a dual interactive tongue according to the present invention. Tongue 702 is virtually identical to the tongues 601 and 602 previously described except that it has its web aperture 708 shaped and sized to accommodate a five-point web system. Thus, aperture 708 is positioned at an acute angle relative to tongue bar 704 to direct the web slidably therethrough changing the direction of the web. Slots 607 and 608 are arranged generally perpendicular to tongue bars 603 and 604 to allow the webs to be fixed thereto as in a three-point web system. Also like the embodiment discussed earlier, tongue 702 includes a tongue bar 704 and a guiding member 706 that ensures that the tongue is not inserted into its belt buckle upside down. Tongue 702 also includes a flange 712 which helps facilitate guiding a pair of tongues into meshing engagement. Finally, tongue 702 includes interactive features formed thereon which includes wedge-shaped projection 714 and an indentation 716.

The counterpart to tongue 702 is shaped identically except that its guiding member is positioned on the other side of its tongue bar as previously discussed with respect to the dual tongue pair 600. Tongue 702 also includes a ridge 718 formed along one side of its main body adjacent its leading edge that serves as a pushing surface when the tongue is advanced into a belt buckle. As with the pair of dual interactive tongues 600 discussed earlier, the counterpart to tongue 702 could approach and mesh from anywhere within the 90° arc shown in FIG. 31. This enables a pair of dual interactive tongues to easily slip into meshed engagement when one of the tongues is partially received in the belt buckle and the other one of the two tongues is advanced into the belt buckle. After the two tongues become meshed, the engagement surfaces pull the other tongue into the belt buckle so that both are simultaneously fully inserted into the belt buckle, thus triggering the latching mechanism.

While the invention has been illustrated and described in detail in the drawings and foregoing description, the same is to be considered as illustrative and not restrictive in character, it being understood that only the preferred embodiments have been shown and described and that all changes and modifications that come within the spirit of the invention are desired to be protected.

What is claimed is:

1. A belt buckle-tongue combination comprising:

a first tongue having a first main body with a first contact surface and a first web attachment aperture, and further including a first tongue bar extending therefrom in a first direction;

a second tongue having a second main body with a second contact surface shaped to mesh with said first contact surface and a second web attachment aperture, and further including a second tongue bar extending therefrom in said first direction;

a buckle main body having a cavity therein shaped to force said first and second contact surfaces to mesh when one of said first and second tongue bars is partially received in said cavity and the other of said first and second tongue bars is inserted into said cavity and advanced in said first direction;

interactive means formed on said first contact surface of said first tongue and said second contact surface of said second tongue and operable when said first tongue is inserted into said buckle main body prior to said second tongue which is thereafter inserted to force both tongues simultaneously fully into said buckle main body when insertion pressure is applied to only one of said tongues in said first direction;

a movable latch mounted in said body and movable from an unlatched position to a latched position wherein said latch engages said first and second tongue bars;

manual operating means accessible at the exterior of the buckle main body for moving said latch between said latched position and said unlatched position to release said first and second tongues from locking engagement with said buckle main body; and false latching means movably mounted in said buckle main body and contactable and moved by said first and second tongues when inserted into said buckle main body, said false latching means being operable to allow said latch to lockingly engage said tongues when said first and second tongue bars are simultaneously fully inserted into said buckle main body but further operable to hold said latch from moving to said latched position when only one of said first or second tongue bars is inserted into said buckle main body.

2. The buckle-tongue combination of claim 1 wherein said interactive means for advancing includes each of said first and second contact surfaces having a pushing surface and an engaging surface; and wherein said pushing surface of one of said contact surfaces engages said engaging surface of the other of said contact surfaces when said contact surfaces are meshed such that both said tongues advance in said first direction when either said first tongue or said second tongue is moved in said first direction.

3. The buckle-tongue combination of claim 2 wherein each said pushing surface and each said engaging surface includes a portion substantially perpendicular to said first direction.

4. The buckle-tongue combination of claim 3 wherein each of said contact surfaces has a wedge shaped projection with said pushing surface at one end and an indentation with said engaging surface at one end; and wherein said indentation on one of said contact surfaces is sized to receive said wedge shaped projection of the other of said contact surfaces such that each said pushing surface contacts one of said engaging surfaces when said contact surfaces are meshed.

5. The buckle-tongue combination of claim 4 wherein said first contact surface is a mirror image of said second contact surface.

6. A pair of tongues lockingly engageable with a dual tongue belt buckle comprising:

a first tongue having a first main body with a first contact surface and a first web attachment aperture, and further including a first tongue bar extending therefrom in a first direction;

a second tongue having a second main body with a second contact surface shaped to mesh with said first contact surface and a second web attachment aperture, and further including a second tongue bar extending therefrom in said first direction;

said contact surfaces including interactive features that prevent said tongues from sliding past each other in said first direction when said contact surfaces are meshed; and wherein said contact surfaces can be meshed by moving said tongues toward each other in a plurality of different directions that are perpendicular to said first direction.

7. The pair of tongues of claim 6 wherein said interactive features include each of said contact surfaces having a pushing surface and an engaging surface; and wherein said pushing surface of one of said contact surfaces engages said engaging surface of the other of said contact surfaces when said contact surfaces are meshed such that both said tongues advance in said first direction when either said first tongue or said second tongue is moved in said first direction.

8. The pair of tongues of claim 7 wherein each said pushing surface and each said engaging surface includes a portion substantially perpendicular to said first direction.

9. The pair of tongues of claim 8 wherein each of said contact surfaces has a wedge shaped projection with said pushing surface at one end and an indentation with said engaging surface at one end; and wherein said indentation on one of said contact surfaces is sized to receive said wedge shaped projection of the other of said contact surfaces such that each said pushing surface contacts one of said engaging surfaces when said contact surfaces are meshed.

10. The pair of tongues of claim 9 wherein said first contact surface is a mirror image of said second contact surface.

11. The pair of tongues of claim 6 wherein said plurality of different directions lie within a 90° arc about an axis defined by said first direction.

12. A method of latching a safety belt buckle comprising the steps of:

providing a pair of individual tongues having a main body with a contact surface, a web attachment aperture and a tongue bar extending from the main body in a direction, wherein the contact surfaces include interactive features that prevent the tongues from sliding past one another in said direction when the interactive features engage one another;

providing a belt buckle that will latch to the pair of individual tongues when the tongues are simultaneously fully inserted into the belt buckle;

inserting one of the tongue bars into the belt buckle in said direction;

inserting the other of the tongue bars into the buckle in said direction until the interactive features of the contact surfaces engage each other; and pushing one of the tongues in said directions so that the engagement of the interactive features will simultaneously advance the other of the tongues until both tongues are fully inserted into the belt buckle and latched thereto.

* * * * *